US005462094A

United States Patent [19]

Josefsson et al.

[11] Patent Number: 5,462,094

[45] Date of Patent: Oct. 31, 1995

[54] SENSOR ACTIVATED WEFT TENSION DEVICE

[75] Inventors: Paer Josefsson, Borås; Kurt A. G. Jacobsson; Lars H. G. Tholander, both of Ulricehamn, all of Sweden

[73] Assignee: IRO AB, Ulricehamn, Sweden

[21] Appl. No.: 211,350

[22] PCT Filed: Sep. 23, 1992

[86] PCT No.: PCT/EP92/02203

§ 371 Date: Jul. 5, 1994

§ 102(e) Date: Jul. 5, 1994

[87] PCT Pub. No.: WO93/06278

PCT Pub. Date: Apr. 1, 1993

[30] Foreign Application Priority Data

Sep. 23, 1991 [DE] Germany ..... 41 31 656.8

[51] Int. Cl.[6] ..... D03D 47/34

[52] U.S. Cl. ..... 139/194; 139/452

[58] Field of Search ..... 139/450, 194, 139/452, 370.2

[56] References Cited

U.S. PATENT DOCUMENTS

| | | | |
|---|---|---|---|
| 4,157,722 | 6/1979 | Tojo et al. | 139/450 |
| 4,359,068 | 11/1982 | Loepfe et al. | 139/450 X |
| 4,875,506 | 10/1989 | Gacsay et al. | 139/450 |
| 4,932,442 | 6/1990 | Ishido et al. | 139/452 |
| 5,002,098 | 3/1991 | Desmet et al. | 139/450 X |
| 5,050,648 | 9/1991 | Pezzoli | 139/450 |
| 5,144,988 | 9/1992 | Del Favero | 139/452 |

FOREIGN PATENT DOCUMENTS

| | | |
|---|---|---|
| 0155431 | 9/1985 | European Pat. Off. . |
| 0356380 | 2/1990 | European Pat. Off. . |
| 0357975 | 3/1990 | European Pat. Off. . |
| 0384502 | 8/1990 | European Pat. Off. . |

*Primary Examiner*—Andy Falik
*Attorney, Agent, or Firm*—Flynn, Thiel, Boutell & Tanis

[57] ABSTRACT

According to a method and apparatus for controlling the insertion process of a weft yarn, the weft yarn is temporarily exposed to a braking friction and the yarn tension is mechanically picked-up. In order to prevent the friction from having a disturbing or damaging effect on the yarn, the yarn tension is only temporarily picked-up during certain phases of the insertion process, in order to derive information from the tension curve that is useful for the control of the insertion process. In a power loom, in particular a jet, rapier or gripper shuttle loom, a tension sensor for sensing the tension of the weft yarn can be switched during insertion between its sensing position and a passive position in which it does not touch the weft yarn. Preferably, the tension sensor is integrated in the insertion brake or even forms the braking element itself.

16 Claims, 2 Drawing Sheets

SENSOR ACTIVATED WEFT TENSION DEVICE

FIELD OF THE INVENTION

The present invention refers to a method of the type wherein the insertion process for a weft yarn into a loom includes exposing the weft yarn to a braking friction and detecting the yarn tension of the weft yarn, and further relates to a loom of the type which includes a weft yarn feeder, a weft yarn insertion brake and a tension sensor for detecting the weft yarn tension.

DESCRIPTION OF THE INVENTION

In the case of a loom known from EP-A2-0 357 975, a tension sensor and an insertion brake are provided downstream of the weft yarn feeder, the insertion brake being controlled in response to the weft yarn tension behavior detected by the tension sensor. However, the tension sensor applies, just as the insertion brake, friction to the weft yarn during the insertion process, and, taking into account the high insertion speeds and short insertion times which are nowadays used, this friction applied is disadvantageous, because a frictional load on the weft yarn also during critical acceleration and high-speed phases exerts an undesirable influence on the development of the insertion process and may damage and possibly break the weft yarn. During the control of the insertion process, the permanently active tension sensor will apply a frictional load to the weft yarn in an undesirable manner even at times at which said weft yarn should be transported as unhindered as possible.

EP-A1-03 56 380 and EP-A1-01 55 431 disclose controlled weft yarn insertion brakes for jet looms, which, in correspondence with the sequence of motions of the weft yarn during the insertion process, become effective in a controlled manner only at intervals for damping the increase in tension which will inevitably occur towards the end of the insertion process due to a whipping effect. In connection with these air-jet looms, it is known to decelerate the weft yarn at the end of the insertion process when a high tension peak occurs due to a whipping effect in the weft yarn resulting from the fact that the weft yarn is stopped; this tension peak may break, locally elongate or retract the weft yarn and it may cause said weft yarn to assume a wavy shape. The braking operation should start a short time before the tension peak occurs, but its intensity and duration should only be of such a nature that the tension peak is reduced, that the weft yarn is in the maximum possible stretched condition before the period of time predetermined for the insertion process expires, and that the free end of the weft yarn reaches the end of the shed before the reed beats up. Hence, the control of the braking operation should precisely be adapted to the actual sequence of movements of the weft yarn during the insertion process. Information on the weft yarn movement which can be used for controlling the braking operation are, for example, passage signals which are produced in the weft yarn feeder when the yarn is drawn off. The moment at which the tension peak occurs is an additional, useful and precise information for the termination of the insertion process and for controlling the braking operation for subsequent insertion processes; on the basis of said information, a possibly existing difference between the movement of the weft yarn coming from the weft yarn feeder and the deviating movement of the weft yarn end in the shed— which deviation may, for example, be caused by a take-off balloon—can be taken into account for controlling the braking operation at the right moments. Furthermore, due to the increase in tension occurring when the reed beats up, the measure of detecting the tension additionally supplies information which will show whether the insertion process has properly been terminated before the beat up takes place, and, prior to this, said measure of detecting the tension also supplies information which will indicate the fact that the insertion process has been started properly as well as the moment at which the weft yarn is released by the yarn feeder for drawing off, said last-mentioned information being supplied on the basis of a tension drop which is detected when the yarn starts its movement at the beginning of the insertion process. If deviations of the tension behavior or temporal deviations of predetermined tension variations which are to be expected occur, it will be possible to make failure reports, to switch off the device, if necessary, or to make corrections for future insertion processes for gradually obtaining insertion processes which have been optimized to a large extent. The detection of the tension, which is carried out by a permanently active tension sensor and which is extremely useful for the above-mentioned purposes because it is simple and because it supplies the necessary information, is, however, disadvantageous insofar as it will interfere with the insertion process in phases which are extremely critical as far as a frictional influence on the weft yarn is concerned.

In rapier looms, the weft yarn should be decelerated at the beginning of the insertion process for guaranteeing that the weft yarn end is taken up reliably, in the intermediate phase, when the weft yarn end is taken over, it should be decelerated for guaranteeing a reliable take over, and at the end of the insertion process it should be declerated for guaranteeing that the weft yarn is correctly stretched and reliably released. Up to now, braking has, for example, been effected continuously, but this causes high increases in tension when the weft yarn is accelerated after having been taken up and taken over. A tension sensor which, separately from the insertion brake, permanently detects the tension mechanically will, however, apply frictional forces to the weft yarn in the acceleration phases, said frictional forces resulting in malfunctions and overlapping the effect of the insertion brake in an undesirable manner.

SUMMARY OF THE INVENTION

It is the object of the present invention to provide a method of the type mentioned at the beginning as well as a loom and an insertion brake by means of which the weft yarn insertion processes can be optimized with respect to the insertion time which is predetermined by the type of loom used and with respect to a careful treatment of the weft yarn.

In the case of said method, this object is achieved by detecting the yarn tension temporarily during the insertion process. In the case of a loom according to the present invention this object is achieved by providing a tension sensor which is switchable between a detection position and a passive position in which the tension sensor does not touch the weft yarn and by an insertion brake according to the present invention wherein a braking element of the insertion brake is constructed as a weft yarn tension sensor or wherein the brake includes a circular counterdisk, a coaxial braking disk and a tension sensor either in a passage of the braking disk or on the circumference of the counterdisk.

During an insertion process, the weft yarn tension is detected temporarily and only in phases in which the friction applied to the weft yarn as a result of the detection does not have any negative influence on the insertion process. In the phase or phases of the insertion process in which the frictional influence on the weft yarn, which inevitably results from the detection of yarn tension, would interfere with or endanger the insertion process, the detection of tension is interrupted. The tension can be detected individually during each insertion process at the moment at which information on the tension behavior or absolute tension values are needed. The tension detection can individually be adapted from one insertion process to the next so that the insertion processes can gradually be optimized. The method realizes the subdivision of an insertion process into critical and uncritical tension detection phases with respect to optimized insertion processes in spite of the tapping of the tension information.

BRIEF DESCRIPTION OF THE DRAWINGS

Embodiments of the subject matter of the invention are explained on the basis of the drawing, in which.

DETAILED DESCRIPTION

Figure 1:
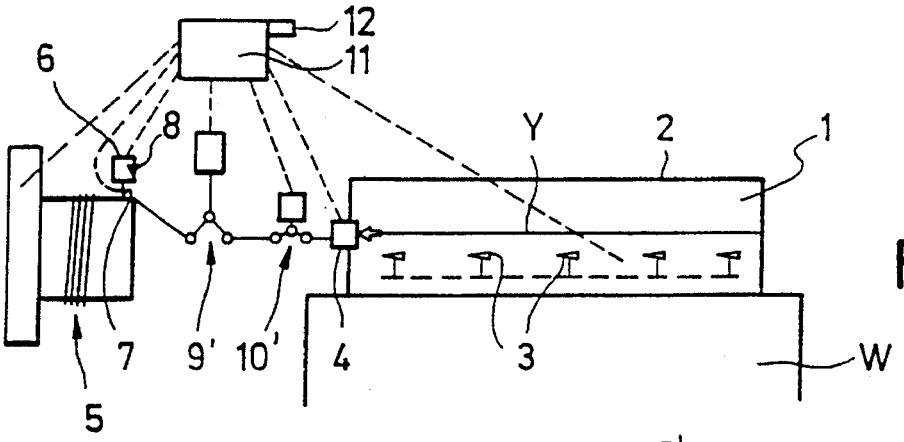
FIG. 1 shows schematically a loom having a weft yarn feeder associated therewith.

A loom W according to FIG. 1, e.g. an air-jet loom, comprises a shed 1 with a reed 2, air nozzles 3 as well as a main nozzle 4 arranged on the inlet side and used as a transport means for inserting a weft yarn Y in the shed 1.

Furthermore, a weft yarn feeder 5 belongs to the loom W, said weft yarn feeder 5 being provided with a stopping device 6 plus associated sopping element 7 and with a passage sensor 8. Downstream of the yarn feeder 5, a controlled insertion brake 9' is arranged in the weft yarn path, and, downstream of said insertion brake, a controlled tension sensor 10' is arranged in the weft yarn path. A control means 11, which is provided with a synchronization device 12 in the case of the separate arrangement of insertion brake 9' and tension sensor 10' shown in FIG. 1, is connected to the individual components of the loom and of the yarn feeder by a signal-transmitting, signal-receiving or controlling connection, as has been indicated by the broken lines.

In the course of each insertion process of a weft yarn section, which has been dimensioned by means of the stopping device 6 in the yarn feeder 5 and which is held with the free weft yarn end in the main nozzle 4 prior to the insertion process, the nozzles 3 and 4 transport the weft yarn Y up to the end of the shed 1 facing away from the yarn feeder 5. Subsequently, before the reed 2 beats up, the weft yarn Y is cut downstream of the main nozzle 4 by means of a cutting device which is not shown. After the beginning of the insertion process, the controlled insertion brake 9' as well as the controlled tension sensor 10' are switched over by the control means 11 to their inoperative or passive positions in which the weft yarn Y is inserted without being decelerated. Towards the end of the insertion process, when a whipping effect may be produced due to the mass of the yarn which is forced to stop and due to the transporting force of the nozzles 3, 4, the insertion brake 9' is switched to the braking position shown in FIG. 1 so as to dampen or suppress a disturbing and possibly even detrimental increase in tension. The insertion brake 9' is controlled e.g. on the basis of passage signals of the passage sensor 8, just as the tension sensor 10', which can, in addition, be synchronized with the insertion brake 9' via the synchronization device 12 with respect to its movement. The tension sensor 10' detects the tension behavior in the weft yarn temporarily and transmits to the control means 11 absolute, relative or temporal information on said tension behavior. The control means processes signals which can be derived from the tension behavior detected. In the separate arrangement shown in FIG. 1, the tension sensor 10' can also be moved asynchronously into its detection position for determining the tension behavior in the weft yarn subsequent to the deceleration and the end of the insertion process, respectively, and prior to the beginning of the insertion process until the weft yarn starts to move, and for deriving information from said tension behavior.

It is, however, important that, in the phases of the insertion process in which friction forces would interfere with the insertion process or be detrimental to the weft yarn, the tension sensor 10' is in its passive position and does not apply any friction to the weft yarn Y.

Figure 2:
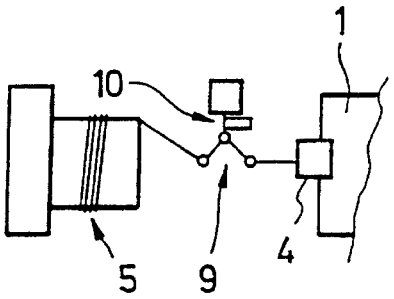
FIG. 2 shows a variation of a detail of FIG. 1.

In the case of the embodiment according to FIG. 2, the tension sensor 10 is structurally integrated in the insertion brake 9 in such a way that an insertion brake element, which deflects the weft yarn for the purpose of braking and applies friction thereto, is simultaneously constructed as the tension sensor 10 or as part of said tension sensor 10. This has the effect that a friction necessary for detecting the tension behavior will be applied to the weft yarn only if the controlled insertion brake 9 simultaneously occupies a braking position.

Figure 3:
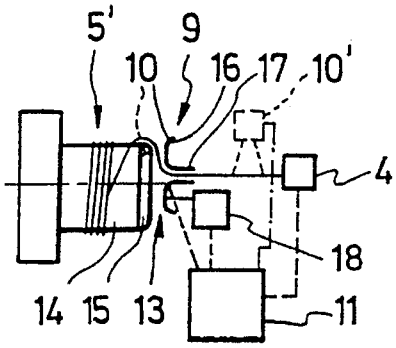
FIG. 3 shows a variation of a detail of FIG. 1.

In the embodiment of FIG. 3 (for a rapier loom), the weft yarn feeder 5' is provided with an insertion brake 9 constructed as an axial disk brake 13. A storage body 14 of the weft yarn feeder 5' has attached thereto a counterdisk 15 at the end face thereof, said counterdisk having a circular circumference. The counterdisk 15 has coaxially associated therewith a braking disk 16, which has a central passage 17 and whose distance from the counterdisk 15 is adapted to be adjusted up to and into a position of contact with the aid of a controlled drive means 18, e.g. by the control means 11, during an insertion process. The weft yarn Y is drawn off the storage body 14, and, in the course of this process, it circulates around the circumferential edge of the counterdisk 15 before it is rerouted inwards between the disks 15 and 16 and axially withdrawn through the passage 17 provided in the braking disk 16. Due to the rerouting and clamping, the braking process can be controlled precisely. If the braking disk 16 is controlled such that it is located far from the counterdisk 15, the then only mild rerouting of the weft yarn will avoid any detrimental frictional influence on the rapier loom during the insertion process. The tension sensor 10 is directly integrated in the insertion brake 9, said tension sensor being integrated either in the passage 17 or in the circumferential edge of the counter disk 15 (indicated by a broken line).

Figure 4:
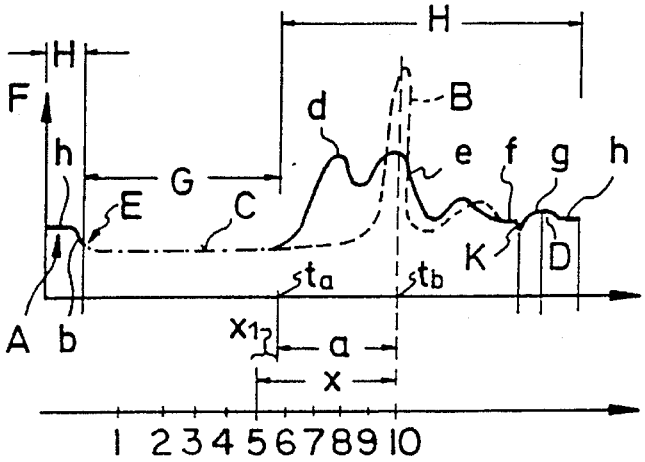
FIG. 4 shows a diagram representing an insertion process in the loom according to FIG. 1.

In the diagram of FIG. 4, the vertical axis represents the weft yarn tension and the horizontal axis represents the time. The process shown in said diagram is a single insertion process. Curve A, which consists of solid lines, represents the tension behavior in the weft yarn during the insertion process when the controlled insertion brake 9', 9 is used. Curve component B, which consists of broken lines, represents the tension behavior in cases in which the weft yarn is not subjected to any braking. The process shown is a typical insertion process in a jet loom having a modern structural design. The two time periods H represent the phases of an insertion process during which the tension behavior in the weft yarn is detected. Time period G, however, represents the phase during which the weft yarn is accelerated until it has reached its maximum speed and is then transported through the shed at said maximum speed. During the time period G, the tension behavior is not detected so as to avoid the application of any disturbing frictional force to the weft yarn (curve component C, shown by a dot-and-dash line as theoretical tension behavior). ta is the moment at which the insertion brake becomes effective. a is the period of time during which braking is carried out. tB represents the end of the braking process and, simultaneously, the occurrence of an extreme tension peak which would occur in the tension behavior at the end of the insertion process if no braking were effected (curve component B consisting of a broken line). tB also represents the moment at which a second increase in tension e occurs; due to the braking force applied, said second increase in tension e is, however, much lower than the extreme increase in tension B occurring if the weft yarn is not decelerated. d is a first increase in tension caused by the braking operation. h is the tension behavior before the insertion process starts in a condition in which the weft yarn is standing still. h is followed by a tension drop b representing at E the start of movement and, consequently, the release of the weft yarn in the stopping device 6 of the yarn feeder 5. In the curve component f, the tension behavior gradually changes towards h because of the weft yarn which has come to a standstill. K represents a tension drop when the weft yarn is cut. Curve component g represents at D an increase in tension upon beating up of the reed, said curve component g being followed by curve component h.

Below the horizontal axis t, a parallel time axis t is shown, which has applied thereto the passage signals (e.g. 1 to 10 for ten turns which have been drawn off) occurring during the insertion process. For the purpose of setting the control means 11, insertion is, for example, first carried out without any braking being effected for determining thus the moment tB which occurs in the case of one type of yarn during each insertion process in a fixed temporal relationship and at the end of the insertion process, said moment tB representing the end of the insertion process. In the case of each insertion process, the same time interval X elapses between tB and a passage signal which has to be chosen, e.g. the passage signal No. 5. By subtracting from the time interval X the braking period a, which has been determined to be expedient for this type of yarn, the time interval x1 is ascertained, said time interval x1 being the time which has to elapse after the occurrence of passage signal No. 5 before the insertion brake 9', 9 is activated. The response time of the insertion brake is, of course, taken into account in this connection. The tension behavior detected (curve A) can be used for deriving therefrom information for the control means 11 so as to be able to find out at which moments and to which extent and for which periods of time the above-mentioned characteristic tension variations occur. This permits a determination of correction signals for adapring the control of e.g. the insertion brake 9', 9, the nozzles 3, 4, the cutting device (not shown), the stopping device 6 and the like, said correction signals being then taken into account for future insertion processes or being registered as positive acknowledgements or as failure reports. The measure of detecting the tension behavior offers the possibility of controlling the insertion brake 9', 9 in the best possible manner, i.e. the undesirable excessive increase in tension at the end of the insertion process will be reduced effectively and, notwithstanding this, it will be guaranteed that insertion conditions exist which have been optimized to a very large extent within the period of time required for an insertion process and predetermined by the type of loom used, that the weft yarn does not break, that it lies in the shed in a stretched condition and that the freee weft yarn end has properly reached the end of the shed. In principle, it would suffice to detect the weft yarn tension essentially during the time period a. The additional information on changes in the tension behavior prior to the beginning and after the end of the insertion process are, however, also important so that tension detection can also be extended to these time periods during which the frictional load applied to the weft yarn in the course of the tension detection does not exert any disturbing influence. The interruption of the tension detection caused by the control of the tension sensor 10' and 10, respectively, during the time period G will, however, avoid a disturbing influence on the insertion process and a detrimental influence on the weft yarn.

Figure 5:
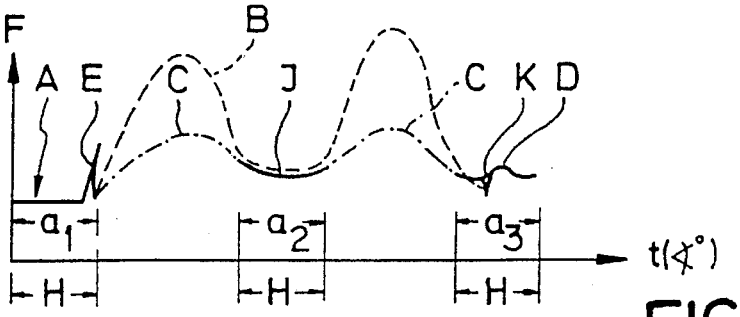
FIG. 5 shows a diagram concerning an insertion process in a rapier loom, FIG. 6A, B show two associated fragmentary sections of an insertion brake with integrated tension sensor, FIG. 7,8,9 show variations of details of FIG. 6A, 6B.

The diagram according to FIG. 5 shows a typical insertion process for a rapier loom on the basis of the tension behavior during the insertion period or during the 360° range of rotation of the loom. Curve components A, which consist of a solid line, represent the tension behavior when a controlled insertion brake is used, the tension behavior being detected either via a separate and synchronized tension sensor 10' (as in the case of FIG. 1) or by means of a tension sensor 10 integrated in the insertion brake, this possibility being shown e.g. in FIG. 2 and 3. Curve components B, which consist of a broken line, represent the tension behavior occurring during conventional methods in the case of which braking is continuously effected throughout the insertion process. Curve components C, which consist of a dot-and-dash line, represent the reduced increases in tension due to the insertion brake which is controlled such that it occupies its position of rest, this being also the phases during which no tension detection is carried out. It can be seen that, in curve components C, the increases in tension are much lower than those in curve components B where braking is continuously effected, whereas in the central area J of curve A the tension drop occurring during controlled braking corresponds to that occurring during permanent braking. Braking is effected during the time periods H (respective braking periods a1, a2, a3), whereas, in the intervals between said time periods H, the insertion brake is controlled such that it occupies its position of rest. The tension in the weft yarn is only detected during the time periods H. In the case of a rapier loom, braking is effected because the first gripper will reliably take up the weft yarn end only if a certain retaining force is effective in the weft yarn, because the first gripper will reliably transmit the weft yarn end to the second gripper only if the weft yarn has applied thereto a retaining force, and, finally, because the second gripper will release the weft yarn end reliably and fully stretch the weft yarn if a retaining force is also effective at the end of the insertion process. In the intermediate acceleration and deceleration phases, braking of the weft yarn is, however, disadvantageous. As far as the control and supervision of the insertion processes is concerned, the information is important, which, on the basis of the tension behavior detection, shows e.g. that the weft yarn started its motion at the tension peak E, that the weft yarn is properly cut when the tension drop K occurs, and that, when the increase in tension D occurs, the correct time interval between beating up of the reed and the other tension variations is confirmed.

In a rapier loom, the control of weft yarn deceleration and of weft yarn tension detection according to the diagram of FIG. 5 can be achieved in a particularly advantageous manner by means of the axial axial disk brake 13 according to FIG. 3 whose drawing-off resistance in the position of rest is so small that it will not influence the insertion process of the rapier loom; it is, however, possible to control said disk brake 13 precisely and sensitively enough for applying the braking force precisely at the important times during the insertion process and for performing then also the yarn tension detection.

Figure 6A:
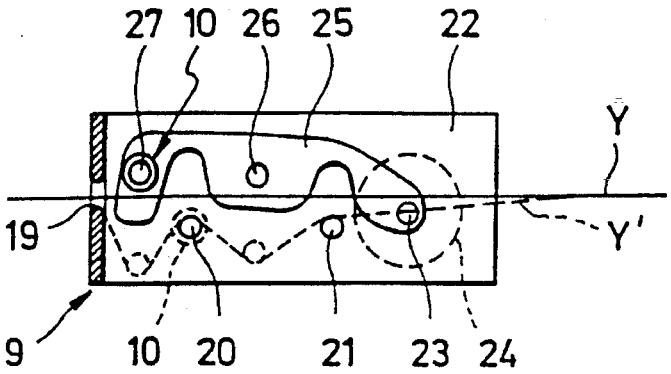
Figure 6B:
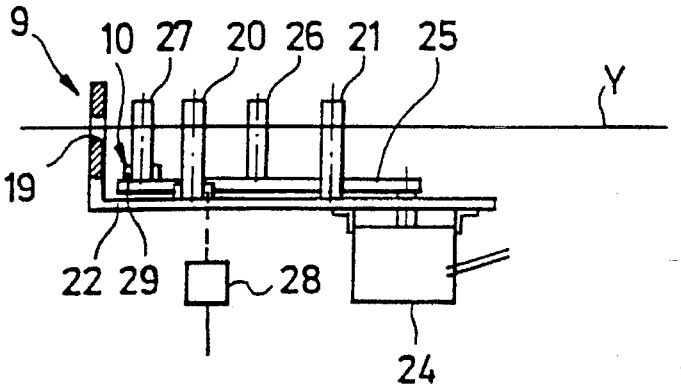
Figure 7:
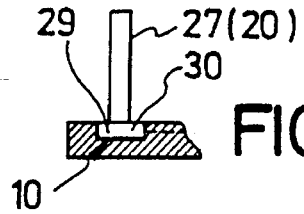
Figure 8:
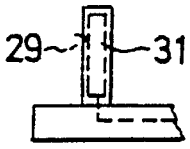
Figure 9:
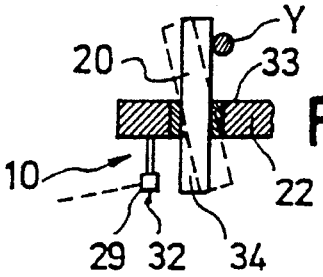

The insertion brake 9 according to FIG. 6A, 6B, which is particularly useful as an insertion brake for jet looms, especially air-jet looms, because, when in its position of rest, said insertion brake 9 permits the weft yarn to pass without causing any friction at all, comprises on a stationary basic body 22 an eyelet as a stationary rerouting element 19 and two additional rerouting points 20 and 21 in the form of pins, said rerouting points 20 and 21 being spaced apart in the direction in which the yarn passes. A shaft 23, which is arranged in said basic body 22, is acted upon by a reversible driving motor 24, e.g. a stepping motor or a d.c. motor; with the aid of the control means, said driving motor can be controlled such that will change its respective direction of rotation during an insertion process in a fast-responding and precisely predeterminable manner and that it will move to respective precisely reproducable rotary positions. A lever 25 is connected to the shaft 23 such that it is secured against rotation relative thereto, said lever 25 carrying two braking elements 26, 27 in the form of pins which are adapted to be moved across the yarn path by means of said lever. In the position of rest shown, the weft yarn Y is not touched. When the lever 25 is moved anti-clockwise in FIG. 6A, the braking elements 26 and 27 will pass between the rerouting elements 19, 20 and 21, whereby the weft yarn Y will be rerouted several times, for decelerating the weft yarn. The insertion brake 9 has integrated therein a tension sensor 10, said tension sensor being defined e.g. by the braking element 27 or by the rerouting element 20. According to FIG. 6B, the tension sensor 10 is provided with a sensing element 29; said sensing element is, according to FIG. 7, 8 and 9, a piezoelectric sensing element 30 on the base of the braking element 27 or of the rerouting element 27 or of the rerouting element 20, or it is a strain-gauge element 31. Furthermore, it is possible to provide the tension sensor 10 with a capacitive sensing member 32 and to hold—for the purpose of detecting the yarn tension of the weft yarn Y abutting on the rerouting element 20—said rerouting element 20 in the basic body 22 in a resilient support 33 as well as to provide it with an extension 34 whose distance or movement is detected by the capacitive sensing member 32. In this connection, it will be expedient to determine the tension in the weft yarn on the basis of the signal of the respective sensing element 29 and then on the basis of the rerouting angle of the yarn which is adapted to be derived from the rotary position of the shaft 23 and of the motor 24, respectively.

Figure 10:
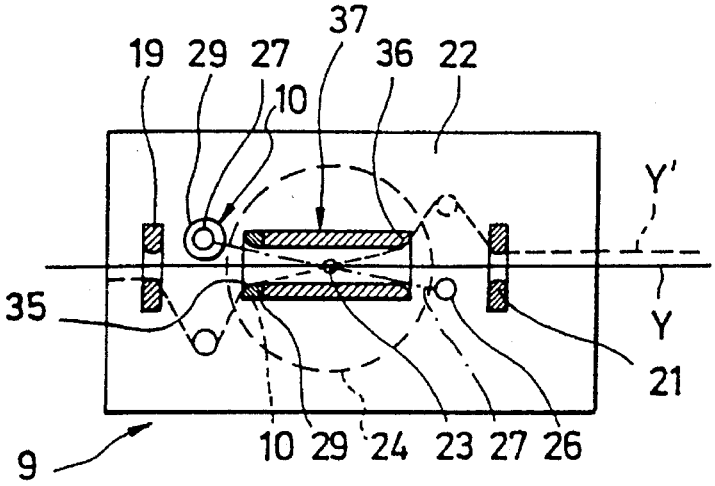
FIG. 10 shows a top view of an additional embodiment of an insertion brake.

The insertion brake 9 according to FIG. 10 is also preferably used for a jet loom, especially an air-jet loom, because in its position of rest (shown by solid lines in FIG. 10) it will permit frictionless and contactless passage of the weft yarn Y and because only in its braking position (one braking position is indicated by broken lines) it will decelerate the weft yarn Y in a precisely controllable manner by rerouting it at several points. The stationary rerouting elements 19 and 21 are provided in the form of eyelets on the basic body 22. Said eyelets have provided between them a coaxial tubular body 37 which defines additional stationary rerouting points 35 and 36 with its ends. The movable braking elements 27 and 26 are attached to the two ends of the lever 25, which is indicated by a broken line, and they are positively connected to the drive 24 via the shaft 23. If the shaft 23 rotates anti-clockwise in FIG. 10, the movable braking elements 27 and 26 will be displaced to the positions which are indicated by a broken line and in which the weft yarn will be rerouted six times, all told, and at the same time effectively be decelerated. The movable braking element 27 can be provided with a sensing element 29 and it can thus be constructed as a tension sensor 10. It is, however, just as well imaginable to construct one of the rerouting elements 19 or 21 as a tension sensor or—as indicated—to unite the tension sensing element 29 with the stationary rerouting element 35 and to construct the tension sensor 10 at this location. The tension in the weft yarn Y is detected when the insertion brake 9 has been displaced to a braking position. If the insertion brake 9 is, however, in its position of rest, the tension of the weft yarn Y will not be detected and, consequently, no detrimental friction will be applied to the weft yarn.

The following functions and supervisions, which can be carried out by the above-mentioned tension sensor which is adapted to be switched over, are essential to the invention:

due to the fact that the tension behavior is supervised, a precise control of the braking effect will be possible at the end of the insertion process, and this will avoid weft yarn faults in the woven fabric and eliminate the undesirable retraction movement of the weft yarn after the whipping effect. The continuous supply of air to the transport nozzles in the shed can thus be reduced or switched off at the end of the insertion process and this will result in a desirably low pressure of the transport nozzles and in a reduced consumption of air. In view of the fact that the time required for stabilizing the weft yarn at the end of the insertion process is now much shorter, the whole period of time available for the insertion can be utilized much better for a more effective insertion process.

The precise information which makes known the end of the insertion process and which can be derived from the tension behavior permits an adjustment of the time delay between the last reliable passage signal and the moment at which the insertion brake is activated. Furthermore, it is possible to exactly determine, through the tension behavior, the response time of the insertion brake under different conditions. Attempts to develop a frictionless tension sensor have already been made for a long time. The tension sensor of the type explained in the present connection, which can be switched over, acts as a frictionless tension sensor at least in the phases of the insertion process in which the friction would interfere with the insertion process.

The measure of detecting the tension in the period before the beginning of the insertion process until the weft yarn starts its motion provides useful information which will show whether or not the main nozzle has properly started to work. If the tension behavior detected shows atypical irregularities, the adjustment of the main nozzle can adequately be modified on the basis of this information From an excessive increase in tension at the end of the insertion process it can be concluded that the main nozzle did not switch off properly; an adequate correction can be carried out at any time taking into account the information on the tension behavior.

The control of the brake and, consequently, of the tension sensor can be carried out by utilization of a trig signal of the loom, or from the yarn feeder, or by a socalled channel-dependent control means.

It is easily possible to detect also absolute tension values by means of the tension sensor and to control the brake with respect to specific, absolute, inadmissible tension values. If, however, only relative tension variations are indicated, the control can be carried out on the basis of a preselected reduction of the tension increase in percent.

More particularly, in the aforesaid loom it is possible to switch over the tension sensor so that the tension detection can be carried out only temporarily and only in phases in which this will not have any negative influence on the weft yarn. The tension sensor offers the possibility of obtaining, in a phase of the insertion process which is uncritical with respect to a frictional influence on the weft yarn, information which concerns the insertion process and which may possibly be used for the control of subsequent insertion processes.

In the case of the above-described method, a braking frictional influence on the weft yarn is a prerequisite for tension detection, said braking frictional influence taking place simultaneously with the tension detection. The reaction forces occurring as a result of the intentional braking are simultaneously used for tension detection in an advantageous manner.

Further, in the case of the method, the temporary tension detection is extended to the phases prior to and subsequent to the actual insertion process; during these phases, no braking is effected. In phases of the insertion process which are critical with respect to a frictional influence exerted on the weft yarn, the tension detection is interrupted. By means of the tension detection, information is obtained, which makes known at which moment and with which influence on the tension in the weft yarn the reed, for example, beats up, the weft yarn is cut, the weft yarn is released for insertion and starts to move, or whether there is perhaps a malfunction. Such malfunctions can be detected on the basis of deviations from a tension behavior which is foreseeable at least in principle, and they may possibly be corrected for future insertion processes or used for switching off.

Furthermore, in the case of the above-described embodiment, tension detection is started at the moment at which also a braking operation is initiated. This is expedient in cases in which the tension sensor is separate from the insertion brake or works separately therefrom.

A structurally simple and particularly important embodiment is provided wherein the tension sensor is integrated in the insertion brake. Due to the fact that the tension sensor is integrated in the insertion brake, a separate tension sensor can be dispensed with and an additional friction point at the weft yarn is avoided. The friction applied during braking and/or the resultant reaction forces and/or the degree of yarn deflection are used for tension detection. The control of the tension sensor is simple because it is effected through the insertion brake.

A particularly expedient embodiment is, in addition, the embodiment wherein the tension sensor is arranged on an element of the insertion brake because the tension sensor has small structural dimensions and can be accommodated at a reasonable price. The tension is detected directly and at the point at which the reaction force of the weft yarn becomes effective.

In addition, for the first time, an optimum control in the case of double weft insertion processes is permitted because each controlled tension sensor shows precisely that the end of its weft yarn has reached the other end of the shed. With the aid of optical means, this has not been possible up to now.

Still further, the tension variations in the weft yarn detected by means of the tension sensor permit a detection of the actual movement of e.g. the weft yarn end in the shed and an adaptation of the control of the insertion brake to the actual sequence of movements. Specific tension variations occur at comparatively identical positions of the weft yarn in the shed, independently of the speed at which the insertion process takes place. The passage signals are only approximately representative of the sequence of movements because mutilating influences, e.g. a take-off balloon, occur between the yarn feeder and the movement of the yarn end in the shed. Although the activation and deactivation of the insertion brake is carried out on the basis of the passage signals, it is possible to adapt, at least to a large extent, said activation and deactivation to the actual sequence of movements by means of the information ascertained on the basis of the tension behavior. The information obtained by means of the tension detection can also be used for adapting auxiliary functions in the course of the insertion process to the actual sequence of movements, e.g. the actuation of transport nozzles, of a cutting means and the like.

In the embodiment where the weft yarn insertion brake is provided with a braking element which is adapted to be moved by means of a controllable drive from one side of the weft yarn to the other side thereof, said braking element coming into contact with said weft yarn in the course of this movement and deflecting the weft yarn thus from its stretched condition, the braking element is constructed as a weft yarn tension sensor.

It follows that, in accordance with an independent inventive concept, a weft yarn insertion brake of this type will be particularly useful for the above-mentioned tasks if the braking element is constructed as a weft yarn tension sensor. A separate weft yarn tension sensor can thus be dispensed with, and, furthermore, an additional friction point at the weft yarn is avoided. Moreover, this is an easy way of obtaining an arrangement in the case of which the tension will only be detected if braking is effected at the same time. In a controlled insertion brake, this will simplify the control of the tension sensor because said tension sensor will reliably be activated in the phases in which braking is effected and will reliably be deactivated in the phases in which no braking is effected.

Also the following embodiment is structurally simple and advantageous. In said embodiment, either the braking element or the rerouting element is constructed as the weft yarn tension sensor. The measure of constructing the rerouting element as the weft yarn tension sensor results in structural simplifications.

With the above-described single-acting or double-acting rerouting brake, e.g. a crocodile brake, a large and effective weft yarn wrapping angle can be adjusted for the purpose of braking and because the reaction forces required for detecting the tension can be tapped clearly and precisely. The drive means is thus used for controlling the insertion brake as well as for switching over the integrated tension sensor.

A reliable tension sensor, which responds rapidly and which has small structural dimensions, is provided in the case of the embodiment using the piezoelectric sensing element, the electronic strain gauge or the capacitive sensing member. The signals, which then have to be further processed, are obtained e.g. by means of calculations on the basis of the measured signals and the yarn rerouting angle at the tension sensor which is simultaneously derived from the control, i.e. the tension in the yarn is determined on the basis of the sensor signals and the yarn rerouting angle at the tension sensor.

Further, with the electric evaluation circuit, the insertion brake is easy to control because the control means has already supplied thereto the evaluated signals of the detected tension behavior and because said control means receives, e.g. for subsequent insertion processes, information for a possible adaptation of the control program for the insertion brake.

In the case of the embodiment of the rapier loom where the insertion brake comprises a stationary counterdisk having a circular circumference and a coaxial braking disk which extends approximately parallel to said counterdisk and which has a central passage for the weft yarn, said weft yarn being fed along a circulatory path around the circumference of the counterdisk, entering then the space between the disk and leaving the insertion brake through said passage, the axial disk brake is constructed as a controllable insertion brake in which the tension sensor is already included, said tension sensor applying, however, friction to the weft yarn only in the activated condition of the insertion brake, whereas it does not exert any frictional influence which would be worth mentioning in phases of the insertion process in which the insertion process may be disturbed or in which damage may be caused to the weft yarn.

The above-mentioned aim is achieved in a simple manner by the insertion brake, which is adapted to be controlled and which, consequently, switches over the tension sensor automatically in such a way that the tension will only be detected in phases in which a braking effect is required as well.

The tension sensor according to the present invention can preferably also be used for detecting the following conditions and for using them for the purpose of processing upon controlling the insertion processes:

- detection of the noise during tension detection as a confirmation for the active presence of the weft yarn in the main nozzle;
- detection of the tension peaks in temporal respect as a temporal information with regard to the fact that an insertion process has been started and finished;
- detection of relative yarn tensions,
- detection of absolute yarn tension values, e.g. by means of the piezoelectric, strain-gauge or induction elements; in so doing, the extent to which the yarn is deflected at the moment in question should be taken into account, said extent of yarn deflection being known from the position of the control shaft; and
- if double weft yarn insertion is carried out, each channel of the main nozzle should have provided therein a tension sensor as a detector for the end of the respective insertion process.

That which is claimed is:

1. A method of controlling the insertion process of a weft yarn into a shed of a loom having a reed which is adapted to be moved for a beating up, said method comprising the steps of accelerating the weft yarn during the insertion process from a condition of standstill at one boundary edge of the woven fabric, transporting the weft yarn through the shed and stopping said weft yarn, and further comprising the steps of exposing the weft yarn temporarily to a braking friction and mechanically detecting the yarn tension at the weft yarn by a tension sensor, comprising the improvement wherein said tension sensor is moved from a passive position spaced part from said weft yarn to a detection position in contact with said yarn for said detecting of said yarn tension and wherein the yarn tension is detected temporarily during the insertion process.

2. A method according to claim 1, wherein the yarn tension is detected while said braking friction is being applied.

3. A method according to claim 2, wherein the yarn tension, in addition to said detection during said insertion process, is additionally temporarily detected during the period in which the weft yarn starts to move at the beginning of the insertion process and/or during the period at the end of the insertion process during said beating up of the reed.

4. In a loom for woven fabric comprising a shed and at least one weft yarn feeder arranged on one boundary edge of the woven fabric for feeding weft yarn, said loom further comprising transport means for inserting the weft yarns into the shed, a weft yarn insertion brake which is adapted to be moved between a rest position and at least one braking position, and a tension sensor used for mechanically detecting the weft yarn tension, said components being arranged downstream of the weft yarn feeder in the path taken by the weft yarn into the shed and each of said components being connected to a control means comprising the improvement wherein the tension sensor includes displacement means for moving said tension sensor during an insertion process between a detection position and a passive position in which said tension sensor does not touch the weft yarn.

5. The loom according to claim 4, wherein a synchronization device is provided for synchronizing at least the switching of the tension sensor to the detection position and the movement of the insertion brake to the braking position, said synchronization device being provided in communication with the control means of the insertion brake.

6. The loom according to claim 4, wherein said insertion brake comprises a plurality of movable braking elements and stationary rerouting elements and the tension sensor is arranged on at least one of said braking elements.

7. In a loom for a woven fabric comprising a shed and at least one weft yarn feeder arranged on one boundary edge of the woven fabric for feeding weft yarn, said loom further comprising transport means for inserting the weft yarn into the shed, a weft yarn insertion brake which is adapted to be moved between a rest position and at least one braking position, and a tension sensor used for mechanically detecting the weft yarn tension, said components being arranged downstream of the weft yarn feeder in the path taken by the weft yarn into the shed and each of said components being connected to a control means, comprising the improvement wherein the tension sensor includes switching means for switching said tension sensor during an insertion process between a detection position and a passive position in which said tension sensor does not touch the weft yarn and wherein a synchronization device is provided for synchronizing at least the switching of the tension sensor to the detection position and the movement of the insertion brake to the braking position, said synchronization device being provided in communication with the control means of the insertion brake.

8. In a loom for a woven fabric comprising a shed and at least one weft yarn feeder arranged on one boundary edge of the woven fabric for feeding weft yarn, said loom further comprising transport means for inserting the weft yarn into the shed, a weft yarn insertion brake which is adapted to be moved between a rest position and at least one braking position, and a tension sensor used for mechanically detecting the weft yarn tension, said components being arranged downstream of the weft yarn feeder in the path taken by the weft yarn into the shed and each of said components being connected to a control means, comprising the improvement wherein the tension sensor includes switching means for switching said tension sensor during an insertion process between a detection position and a passive position in which said tension sensor does not touch the weft yarn and wherein the tension sensor is integrated in the insertion brake and is adapted to be controlled in synchronism therewith.

9. A loom according to claim 8, wherein the tension sensor is arranged on an element of the insertion brake which frictionally influences the weft yarn during the braking operation or wherein the tension sensor is the element itself.

10. A loom according to claim 8, wherein a main nozzle is provided for double weft yarn insertion and wherein said tension sensor, which is adapted to be switched between said detection position and said passive position and which is integrated in said separate insertion brake, is provided as an insertion end detector for each weft yarn.

11. A loom according to claim 8, wherein the weft yarn is in a stretched condition during insertion of said weft yarn into the shed, the weft yarn insertion brake is provided with a braking element which is adapted to be moved by means of a controllable drive from one side of the weft yarn transversely to said weft yarn, and in the course of this movement said braking element comes into contact with said weft yarn thus deflecting said weft yarn from its stretched condition, and wherein the braking element of the controlled yarn brake is constructed as a weft yarn tension sensor.

12. A loom according to claim 10, wherein the insertion brake is constructed as a single-acting or as a double-acting rerouting brake comprising a plurality of movable braking elements and stationary rerouting elements, said controllable drive for the braking elements and said integrated weft yarn tension sensor.

13. A loom according to claim 12, wherein the tension sensor is a sensor responding to the load applied to said braking or rerouting element when the weft yarn is being deflected and selected from the group consisting of at least one piezoelectric sensing element, an electronic strain-gauge element, or a capacitive sensing member.

14. A loom according to claim 13, wherein the tension sensor is connected via an electric evaluation circuit to the control means for the drive of the insertion brake.

15. In a loom for a woven fabric comprising a shed and at least one weft yarn feeder arranged on one boundary edge of the woven fabric for feeding weft yarn, said loom further comprising transport means for inserting the weft yarn into the shed, a weft yarn insertion brake which is adapted to be moved between a rest position and at least one braking position, and a tension sensor used for mechanically detecting the weft yarn tension, said components being arranged downstream of the weft yarn feeder in the path taken by the weft yarn into the shed and each of said components being connected to a control means, comprising the improvement wherein the tension sensor includes switching means for switching said tension sensor during an insertion process between a detection position and a passive position in which said tension sensor does not touch the weft yarn and wherein the weft yarn feeder has provided therein at least one weft yarn passage sensor, which is connected to the control means and with the aid of which successive passage signals are produced during an insertion process, and wherein the insertion brake is adapted to be controlled by said control means on the basis of said passage signals and on the basis of position signals of the weft yarn in the shed, which are derived from the weft yarn tension behavior detected by means of the tension sensor.

16. In a loom for a woven fabric comprising a shed and at least one weft yarn feeder arranged on one boundary edge of the woven fabric for feeding weft yarn, said loom further comprising transport means for inserting the weft yarn into the shed, a weft yarn insertion brake which is adapted to be moved between a rest position and at least one braking position, and a tension sensor used for mechanically detecting the weft yarn tension, said components being arranged downstream of the weft yarn feeder in the path taken by the weft yarn into the shed and each of said components being connected to a control means, comprising the improvement wherein the tension sensor includes switching means for switching said tension sensor during an insertion process between a detection position and a passive position in which said tension sensor does not touch the weft yarn and wherein the insertion brake comprises a stationary counterdisk having a circular circumference and a coaxial braking disk extending approximately parallel to said counterdisk and having a central passage, said weft yarn being fed along a circulatory path around the circumference of the counterdisk, entering then the space between the counterdisk and the braking disk and leaving the insertion brake through said passage wherein, during an insertion process, the braking disk can be controlled such that its distance from the counterdisk can be varied up to and into a position of contact with said counterdisk by means of a drive connected to the braking disk, and wherein the tension sensor is provided either in the passage of the braking disk or on the circumference of the counterdisk.

* * * * *

UNITED STATES PATENT AND TRADEMARK OFFICE

CERTIFICATE OF CORRECTION

PATENT NO. : 5 462 094

DATED : October 31, 1995

INVENTOR(S) : Paer JOSEFSSON, et al

It is certified that error appears in the above-indentified patent and that said Letters Patent is hereby corrected as shown below:

Column 13, line 30; change "claim 10," to ---claim 11,---.

Column 14, line 38; after "passage" insert ---for the weft yarn---.

Signed and Sealed this

Thirtieth Day of April, 1996

Bruce Lehman

*Attest:*

BRUCE LEHMAN

*Attesting Officer*

*Commissioner of Patents and Trademarks*